United States Patent [19]

Read

[11] 4,221,389

[45] Sep. 9, 1980

[54] WAR GAME APPARATUS

[76] Inventor: Anthony M. Read, 3890 Hudson St., Vancouver, B. C., Canada, V6H 3A8

[21] Appl. No.: 903,577

[22] Filed: May 8, 1978

[30] Foreign Application Priority Data

Jun. 10, 1977 [GB] United Kingdom ..... 24350/77

[51] Int. Cl.[3] ..... A63F 3/00

[52] U.S. Cl. ..... 273/262; 273/291

[58] Field of Search ..... 273/258, 248, 255, 262

[56] References Cited

U.S. PATENT DOCUMENTS

| | | | |
|---|---|---|---|
| 972,382 | 10/1910 | Johnson-Jervis | 273/255 |
| 1,294,256 | 2/1919 | George | 273/262 |
| 1,382,695 | 6/1921 | Van Vleet | 273/255 |
| 1,418,409 | 6/1922 | Wakefield | 273/262 |
| 2,464,819 | 3/1949 | Lieberman | 273/262 |
| 3,414,264 | 12/1968 | Schriber | 273/246 |

FOREIGN PATENT DOCUMENTS

| | | | |
|---|---|---|---|
| 224182 | 11/1924 | United Kingdom | 273/262 |

*Primary Examiner*—Richard C. Pinkham
*Assistant Examiner*—Carl Moy
*Attorney, Agent, or Firm*—Carver & Company

[57] ABSTRACT

Game apparatus for a game which has a board representing a battlefield divided into a plurality of spaces to receive game pieces. The spaces are in a rectangular grid having a first pair of oppositely disposed margins having adjacent spaces representing trenches, and a second pair of oppositely disposed margins having adjacent spaces representing gun positions. Gun pieces located in the gun positions are oriented before firing so that their range is unknown to the opponent and pairs of guns can be interchanged before the guns have been fired, which is a realistic representation of a battlefield situation. Some spaces on the board are designated as being within range of a particular type of gun and tank pieces moving along the board from one trench towards the other trench are subjected to gun fire from an opponent's guns, if he so desires, when positioned on a particular space within range of a particular gun.

6 Claims, 5 Drawing Figures

-FIG. 1-
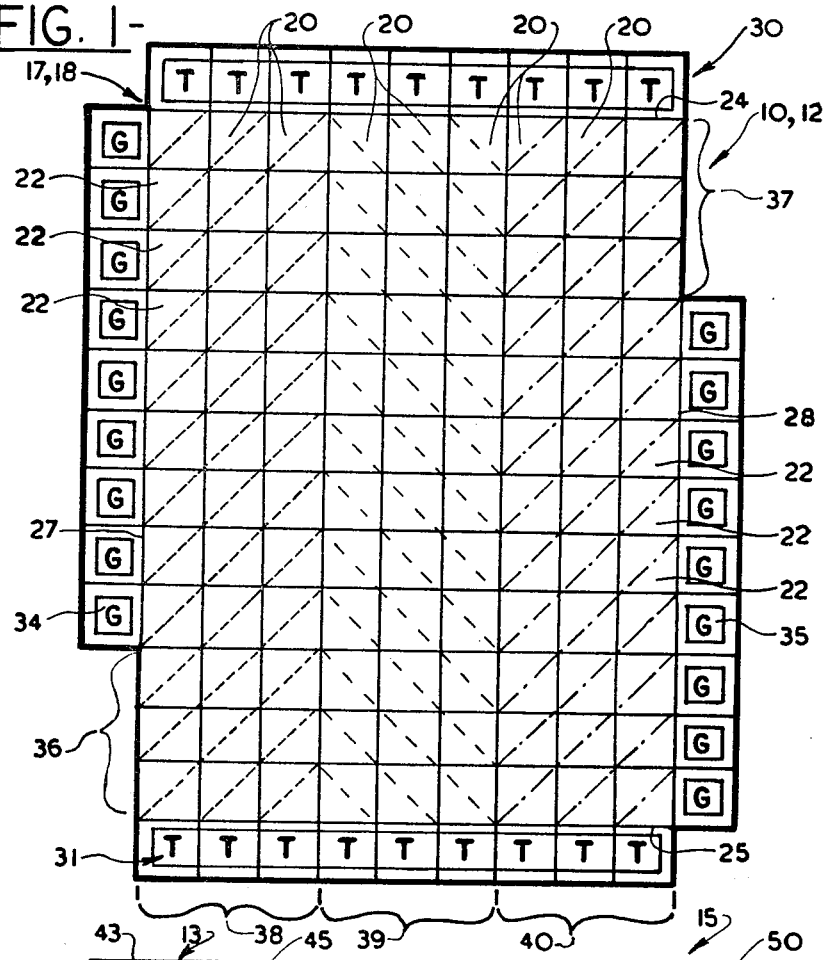
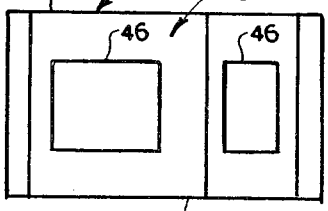
-FIG. 2-
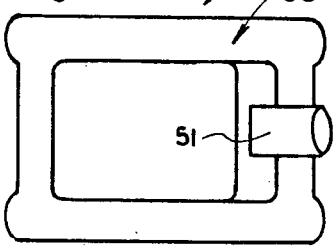
-FIG. 4-
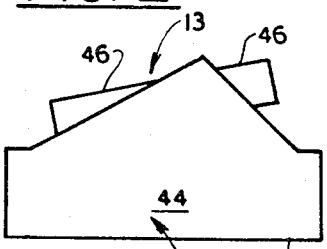
-FIG. 3-
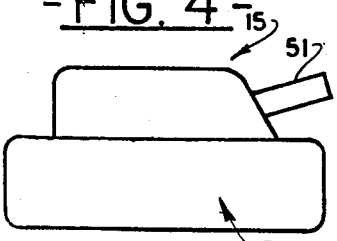
-FIG. 5-

WAR GAME APPARATUS

BACKGROUND OF THE INVENTION

1. Field of the Invention

The invention relates to board games, particularly a game of movement and counter movement of game pieces as in a war game.

2. Prior Art

Board games in which two opponents make moves and counter moves are well known, and often such games represent various aspects of battles or war. Some games are characterized by each player having a plurality of different pieces, the pieces being limited to certain types of moves, which results in a complex game which can last for many hours, and in fact sometimes for several days. Chess is probably the oldest and best known example of this type of war game. Some of the more modern games attempt to represent a battle situation very realistically and become correspondingly complex and require elaborate game boards with associated elaborate apparatus. In many of the games, the player is aware of his opponent's defence as this is clearly displayed by positions of games pieces on the board, and sometimes luck plays a dominant role in determining who is the winner of the game. Whilst many of the games encourage forethought and strategy in planning moves, an opponent's positions and strengths are usually clearly visible by positions of his game pieces on the board and often this does not reflect a true battlefield situation where commonly the opponent or enemy's strength and position are not known for certain.

SUMMARY OF THE INVENTION

The present invention reduces some of the unrealities, complexities and disadvantages of the prior art games by providing a game which has a relatively simple board and simple game pieces. Notwithstanding the simplicity of the present invention, in some aspects it represents a battlefield situation more closely than many of the prior art more complex games by permitting the players to conceal from each other, to a limited extent, their strengths in particular areas. In particular, the players each have guns or other weapons which the player is not required to fire until he desires, and the range of the weapon is not known until it has been fired, which can be considered to represent more closely a true battlefield situation.

The game apparatus according to the invention has a plurality of game pieces and a game board, the game board representing a battle area divided into a plurality of spaces to receive the game pieces. The game pieces include a plurality of mobile weapon pieces and interchangeable weapon pieces. In one embodiment, the battle area is disposed within a rectangular grid and the plurality of spaces are disposed in vertical columns and horizontal rows. The mobile weapon pieces are identified as belonging to each player and adapted for generally longitudinal movement of the board. The interchangeable weapon pieces have an identification to represent range of that particular interchangeable weapon, the identification corresponding to particular spaces on the board and being marked on the game piece in such a manner as to be easily hidden from an opponent, when required. The board is further characterized by first and second pairs of oppositely disposed margins. Each margin of the first pair has a respective plurality of spaces adjacent thereto which represent bases. Each margin of the second pair has a respective plurality of spaces adjacent thereto which represent interchangeable weapon positions, the second pair of margins being disposed generally laterally of the longitudinal movement of the mobile weapon pieces. The board further includes a plurality of spaces identified as being within range of a type of interchangeable weapon piece, the range of a particular interchangeable weapon being measured generally laterally from a particular weapon position to the particular space. The plurality of spaces identified as being within the range of a particular type of interchangeable weapon piece is divided into at least two groups, each said identified space within a particular group having an indication thereon. The indication on each said identified space is identical to the indication on every other said identified space within the same group and is distinct from the indication on said identified spaces in every other group. The weapon pieces are divided into a plurality of groups with each interchangeable weapon piece within a particular said group having an indication thereon corresponding to the indication on the said identified spaces within a particular said group of spaces. The indication on each piece in each said group of pieces being identical to the indication on each other piece within the same group and distinct from the indication on every other piece in said other groups of pieces. Each said interchangeable piece is able to attack a mobile piece resting on an identified space corresponding to said interchangeable piece.

A method of playing the game on a board as above identified is characterized by each player placing his mobile weapon pieces in the spaces representing his own bases and his interchangeable weapon pieces in the spaces representing his own interchangeable weapon positions, the interchangeable weapons being positioned so that his opponent is not aware of the range of each interchangeable weapon. Each player then sequentially moves his own game pieces representing mobile weapons from one end of the board representing his own bases towards the opponent's end, the players alternating turns. If desired, each player fires one of his own interchangeable weapons when the opponent is on a space within range of that particular weapon and, after firing it, the range of that interchangeable weapon is revealed to his opponent. If desired, each player fires his own mobile weapon at a mobile weapon of his opponent when within range of his particular mobile weapon. The game is finished by one player having more of his own mobile weapons than his opponent reach the spaces representing the bases of the opponent, or if both players have equal numbers of mobile weapons remaining, the winner is the first player to have all his remaining mobile weapons in his opponent's bases.

A detailed disclosure following, related to the drawings, describes a preferred embodiment of the apparatus according to the invention which, however, are capable of expression in structure and method other than that particularly described and illustrated.

DESCRIPTION OF THE DRAWINGS

FIG. 1 is a simplified plan of a game board according to the invention,

FIG. 2 is a top plan of one example of an anti-tank gun piece according to the invention, FIG. 3 is a side elevation of the gun piece of FIG. 2, FIG. 4 is a top plan of a tank piece according to the invention, FIG. 5 is a side elevation of the tank piece of FIG. 4.

DETAILED DISCLOSURE

The description following, for simplicity, relates to tanks and anti-tank guns, but other weapons and vehicles can be substituted as will be described.

FIG. 1

A game apparatus 10 according to the invention includes a game board 12, a plurality of anti-tank gun pieces 13, which are to be described with reference to FIGS. 2 and 3, and a plurality of tank pieces 15, which are to be described with reference to FIGS. 4 and 5. The board 12 has an area 17 representing a battlefield or battle area divided into a plurality of spaces to receive the game pieces. The plurality of spaces are disposed within a rectangular grid 18 containing a plurality of vertical columns of spaces, some of which are designated 20, and a plurality of horizontal rows of spaces, some of which are designated 22.

The board is further characterized by top and bottom margins 24 and 25 forming a first pair of oppositely disposed margins, and left and right hand side margins 27 and 28 forming a second pair of oppositely disposed margins. The board has a horizontal row of nine spaces 30 disposed adjacent the top margin 24 of the board representing trenches or bases belonging to a first player, and a similar horizontal row of nine spaces 31 disposed adjacent the bottom margin 25 representing trenches or bases of the second player. The rows 30 and 31 are parallel to the rows of spaces and can be identified with the letter "T" representing trenches or initial tank positions. A vertical column of nine spaces 34 is disposed adjacent the side margin 27, and a similar vertical column of nine spaces 35 is disposed adjacent the side margin 28 of the board. The columns 34 and 35 represent gun positions and are disposed adjacent each side margin of the board and arranged so as to be parallel to the column of spaces. The gun positions can be identified with the letter "G" and there are nine gun positions for each player located so as to be adjacent an end of the board containing trenches of that particular player. Thus, the gun positions or spaces 34 adjacent the left hand side margin 27 of the board are also adjacent the top margin 24 of the board and belong to the first player, and the gun positions or spaces 35 adjacent the right hand margin 28 of the board are adjacent the bottom margin 25 and belong to the bottom player. Thus the column of spaces 34 representing gun positions does not extend the full length of the board but terminates above the bottom margin 25 leaving three rows of spaces 36 adjacent the bottom trenches 31 unprotected by the guns of the first player. This is termed an unprotected area for the first player, and is the balance of the horizontal rows that are not protected by guns of both players. Similarly, three rows of spaces 37 adjacent the top trenches 30 are an unprotected area for the second player. For each player the remaining positions of the battlefield are termed "protected areas" for the respective players depending upon which guns cover the particular spaces.

Thus, it can be seen that each margin of the first pair of margins has a respective plurality of spaces adjacent thereto which represent trenches, and each margin of the second pair of margins has a respective plurality of spaces adjacent thereto which represent gun positions.

In the particular example shown in FIG. 1, the board has nine vertical columns of twelve spaces each extending between the top and bottom margins of the board, and twelve horizontal rows of nine spaces each extending between side margins of the board. As will be discussed, limited variations from these particular numbers of columns and rows are permissible, but the game then tends to become either too simplified with lesser numbers of columns and/or rows, or too complicated with greater numbers.

The nine columns of spaces are arranged in three equal groups, each group therefore containing three columns, the groups of columns being designated 38, 39 and 40, and identified as being within a range of a particular type of gun. The columns can thus be marked in a particular manner or merely colored differently, for example the group 38 can be blue, the group 39 can be red and the group 40 can be green. It can be seen that the columns are thus arranged in groups of spaces disposed parallel to the margins of the board adjacent the spaces representing the gun positions. As will be described with reference to FIGS. 2 and 3, each gun piece has an identification to indicate a range of the particular gun, and thus the board has a plurality of spaces, each space being identified as being within the range of a particular type of gun, the range being measured generally laterally of, or normally to, the columns from a particular weapon position to the particular space.

FIGS. 2 and 3

The anti-tank gun piece 13 has a generally triangular prism-shaped body 45 having opposite sides 43 and 44 and a gun barrel 46 extending therefrom. The gun barrel is marked with a particular color to indicate its range, which corresponds with one of the colors of the groups of columns 38, 39 and 40 on the board and thus would be either blue, red or green in the particular example described. As the gun pieces remain in the particular columns representing gun positions, they do not require marking to indicate the particular player and thus the color of the body is immaterial. Thus the gun has an identification to indicate range of the gun and the identification is marked on the gun piece so as to correspond to particular spaces on the board so identified to be within range of that gun. The identification is in such a location on the gun piece as to be easily hidden from the opponent when required and this can be effected by placing the gun on one of its sides 43 and 44 with a lower surface 47 thereof facing the opponent. In this way, the color of the barrel cannot be seen by the opponent and thus the range of the gun is not known to the opponent.

FIGS. 4 and 5

The tank piece 15 has a body and track portion 50 and a gun barrel 51 extending from the body, the tanks being identified so as to belong to a particular player, for example black and white similarly to chess pieces. The guns of the tanks project from the front of the tank and thus indicate its forward direction.

OPERATION

The game is to be played by two players, each player taking a color determined by the tanks, for instance black and white, the first player having the trenches 30 adjacent the top margin 24 of the board, as shown in FIG. 1, and the second player having the trenches 31 adjacent the bottom margin 25. Each player has nine tanks of his particular color and three anti-tank guns of the red range, three guns of the blue range and three guns of the green range. Each player places his own tanks on the respective row of spaces 30 or 31 marked T, representing his own trench, with the tanks facing towards the center of the board. Each player also places his nine anti-tank gun pieces in the adjacent column of spaces 34 or 35 representing gun positions, the anti-tank guns facing across the board and placed so that the color marking of the pieces is not visible to the opposing player. Each gun piece is placed on one of its sides 43 and 44 with the lower surface 47 of the tank facing the opponent. In this manner the color designating the range of each anti-tank gun is hidden from the opposing player until the gun is fired as will be described.

Movement of the tanks is governed by the following rules:

(a) A tank cannot move sideways within its own trench.

(b) In the larger portion of the battlefield covered by its own anti-tank guns, ie. the protected areas of the particular player, the tank can move forward one or two spaces, sideways one or two spaces and diagonally forward one or two spaces.

(c) In the unprotected portion of the battlefield, ie. the areas 36 or 37 when the particular tank is not protected by its own anti-tank guns, the tank can move forward one space, sideways one space and diagonally forward one space only.

(d) A tank cannot move backwards anywhere on the battlefield.

(e) When a tank reaches the enemy trenches it is cleared from play.

(f) The guns of the tanks have a range of two battlefield spaces directly ahead, and a first tank can shoot and destroy an opposing second tank only if the second tank actually stops at the end of a move on a space one or two spaces directly in front of the first tank. This means that a tank cannot shoot another tank crossing its line of fire, that is a tank that is moving sideways two spaces and passing through an intermediate position in front of an opposing tank.

(g) When a tank is destroyed, the tank is turned upside down and the destroyed tank then becomes an obstacle so that the space which it occupies cannot be used by another tank.

(h) A destroyed tank cannot shoot.

(i) A destroyed tank becomes an obstacle for guns, either anti-tank guns or tank guns, because any type of gun cannot shoot beyond a destroyed tank within its range regardless of which side the destroyed tank belongs to.

(j) A tank cannot destroy an anti-tank gun.

Anti-tank guns are used as follows:

(a) Before an anti-tank gun is fired, it can be interchanged with another anti-tank gun if the other gun also has not been fired. It is usual to interchange anti-tank guns of different ranges, although anti-tank guns of the same range if not fired can also be interchanged to confuse or bluff the opponent, or also as a delay or stall tactic. As will be described, interchanging guns is considered as a move and yet this does not result in movement of tank pieces on the battlefield.

(b) An anti-tank gun identified as red has a field of fire directly across the battlefield, that is along the rows and normal to the columns, only into the three spaces designated red. Similarly, the blue and green guns have ranges of fire directly across the battlefield only in spaces designated blue and green respectively.

(c) An anti-tank gun can only destroy a tank that has completed a move and is stopped in the field of fire of the anti-tank gun. Thus, if a tank is making a move of two spaces and instantaneously enters a field of fire of a particular anti-tank gun and then leaves the field to complete the move, that gun cannot shoot the tank. This is similar to the limitation relating to a tank firing at another tank.

(d) Once an anti-tank gun has been fired, its color marking, and therefore its range, is made visible to the opposing player and also it cannot be repositioned, ie. its location on the board is fixed. Thus, when an anti-tank gun has been fired, the gun is reoriented from the position laying on its side to an upright position, thus clearly indicating the range of that gun to the opponent.

(e) An anti-tank gun does not have to destroy a tank that is within its range. Thus, if a player wishes to keep the range of a particular gun secret, even if an opponent's tank occupies a space in the range of the gun, he does not have to fire the gun. This aspect of the game is similar to a realistic war situation where opponents sometimes do not reveal their position by delaying firing their guns.

(f) An anti-tank gun can shoot beyond a tank that has not been destroyed, irrespective of the ownership of the tank. Thus if a tank is located on a green square in front of an anti-tank gun having a range red and located on the right hand side column 35, that particular anti-tank gun can fire over the tank to one of the three spaces in the column coloured red.

The purpose of the game is for a player to move the greatest number of his tanks into his opponent's trenches as quickly as possible. The players alternate moves and a move consists of either a tank movement, according to the number of spaces moved as above, or the interchanging of any two unfired anti-tank guns. Prior to a player's move as defined above, the player may fire either an anti-tank gun or a tank gun. A move therefore can include firing one gun only, if desirable, and then moving the tank piece or interchanging two unfired anti-tank guns. Note that it is not permitted to move a game piece and then fire a gun. Note that a move by a player involving interchanging unfired anti-tank guns must be followed on the next move by the same player with a tank movement. That is, one particular player cannot move two anti-tank guns in succession—this is to eliminate excessive delaying tactics.

Thus, it can be seen that each player sequentially moves his own game pieces representing tanks from one end of the board representing his own trenches towards the opponent's end, with the players alternating turns. If desired, each player fires one of his own anti-tank guns when the opponent is on a space within range of that particular anti-tank gun, and, after firing the gun, revealing the range of the gun to his opponent. If desired, each player fires his own tank piece at a tank piece of his opponent when within range of the gun of his particular tank piece. The game is finished by one player having more of his own tanks in his opponent's trenches than the opponent has in his own trenches. To eliminate the possibility of a draw or tie, if both players have equal numbers of tanks in the opponent's trenches, it is the player who first has all his remaining tanks in his opponent's trenches.

ALTERNATIVES AND EQUIVALENTS

The board is shown with nine vertical columns of spaces and twelve horizontal rows of spaces extending between the top and bottom margins and side margins of the board respectively. It is considered that the main advantages of the invention could be attained by having a board with between six and sixteen vertical columns of spaces and between eight and twenty horizontal rows of spaces. Nine gun positions are shown for each play, but between six and twelve would be suitable depending on the size of the board. Clearly there can be no more interchangeable weapon positions than horizontal rows of spaces, and preferably unprotected areas should remain adjacent the opposing player's trenches. Three groups of columns are designated for different gun ranges, and whilst one group would be operative to a very limited degree, two through four groups are preferred. Because one of the major aspects of the game relates to the unknown range of the opponent's guns, if all guns had the same range, there would be little room for variations in strategy of play. For simplicity and easy terminology, the game is described in a war or battle environment using anti-tank guns and tanks as the game pieces. Clearly, other weapons and/or vehicles could be substituted such as cannons and ships, bows and arrows, foot soldiers and cavalry, laser guns and space ships, etc. In broad terminology, the essentially longitudinal movements of the major moving armed game pieces, ie. the vehicles or people which are termed mobile weapons, are influenced by unpredictable selected actions of essentially static game pieces which can be interchanged with each other before firing and are termed interchangeable weapons. The interchangeable weapons are disposed laterally of the longitudinal movement of the major mobile weapon game pieces and clearly the presence and unpredictable actions of the interchangeable weapons has an influence on the movement of the mobile weapons. It is considered that a major aspect of the game relates to the relatively unpredictable actions of the laterally situated interchangeable weapon game pieces, and thus any combination of longitudinally mobile weapons that includes this interchangeable and unknown aspect of laterally disposed weapons is considered to be within the invention.

I claim:

1. A game apparatus having a plurality of game pieces and a game board, the board representing a battle area disposed within a rectangular grid and containing a plurality of vertical columns of spaces and horizontal rows of spaces to receive the game pieces, (i) the game pieces being further characterized by:

(a) a plurality of mobile weapon pieces identified as belonging to each player and adapted for generally longitudinal movement of the board, (b) a plurality of interchangeable weapon pieces, each interchangeable weapon piece having an identification to represent range of that particular interchangeable weapon, the identification corresponding to particular spaces on the board and being marked on the game piece in such a location as to be easily hidden from an opponent when required, (ii) the game board being further characterized by:

(a) a first pair of oppositely disposed margins of the rectangular grid, each margin having a respective plurality of spaces adjacent thereto which represent bases, (b) a second pair of oppositely disposed margins disposed along the remaining margins of the rectangular grid, each margin having a respective plurality of spaces adjacent thereto which represent interchangeable weapon positions, the second pair of margins being disposed generally laterally of the longitudinal movement of the mobile weapon pieces, (c) a plurality of the spaces of the board being identified as being within range of a type of interchangeable weapon piece, the range of a particular interchangeable weapon being measured generally laterally from a particular interchangeable weapon position to the particular space, the plurality of the said identified spaces being divided into at least two groups, each said identified space within a particular said group having an identification thereon, the indentification on each said identified space being identical to the indentification on every other said identified space within the same group, and being distinct from the identification on said identified spaces in every other group, (iii) the pieces being further characterized by:

(a) the plurality of interchangeable weapon pieces being divided into a plurality of groups of particular types of weapons, with (b) each interchangeable weapon piece within a particular said group having an identification thereon corresponding to the identification on the said identified spaces within a particular said group of spaces, the identification on each piece in each said group of pieces being identical to the identification on each other piece within the same group and distinct from the identification on every other piece in said other groups of pieces, whereby each said interchangeable weapon piece is able to attack a mobile piece resting on an identified space corresponding to the said interchangeable weapon piece.

2. A game apparatus as claimed in claim 1 in which the board is further characterized by:

(a) between six and sixteen vertical columns of spaces extending between top and bottom margins of the board, (b) between eight and twenty horizontal rows of spaces extending between side margins of the board, (c) a vertical column of spaces containing between six and twelve spaces representing interchangeable weapon positions being provided adjacent each side margin of the board, there being no more interchangeable weapon positions than horizontal rows of spaces, (d) at least two groups of columns of spaces being identified as being within range of a particular type of interchangeable weapon.

3. A game apparatus as claimed in claim 2 in which the board is further characterized by:

(a) nine vertical columns of twelve spaces each extending between the top and bottom margins of the board, the columns being arranged in three equal groups, each group being identified as being within range of a particular type of interchangeable weapon, (b) twelve horizontal rows of nine spaces each extending between side margins of the board, (c) a row of nine spaces representing trenches being disposed adjacent the top and bottom margins of the board, and arranged so as to be parallel to the rows of spaces, (d) a column of nine spaces representing interchangeable weapon positions being disposed adajcent each side margin of the board and arranged so as to be parallel to the columns of of spaces, the interchangeable weapon positions of a particular player being located so as to be also adjacent an end of the board containing bases of that particular player, (e) three horizontal rows of nine spaces adjacent the top and bottom margins of the board being the balance of rows that are not protected by interchangeable weapons of both players, thus representing unprotected areas for each player.

4. A game apparatus having a plurality of game pieces and a game board, the board representing a battle area divided into a plurality of spaces to receive the game pieces, the game pieces being further characterized by:

(a) a plurality of mobile weapon pieces identified as belonging to each player and adapted for generally longitudinal movement of the board, (b) a plurality of interchangeable weapon pieces, each interchangeable weapon piece having a coloured portion to represent range of that particular interchangeable weapon, colour of the coloured portion corresponding to particular spaces on the board and being marked on the game piece in such a location as to be easily hidden from an opponent when required, the game board being further characterized by:

(c) a first pair of oppositely disposed margins, each margin having a respective plurality of spaces adjacent thereto which represent bases, (d) a second pair of margins disposed in parallel columns adjacent remaining opposite margins of the board, each margin having a respective plurality of spaces adjacent thereto which represent interchangeable weapon positions, the second pair of margins being disposed generally laterally of the longitudinal movement of the mobile weapon pieces, (e) a plurality of the spaces of the board being identified by colour as being within range of a particular type of interchangeable weapon piece, such spaces being arranged in differently coloured groups disposed parallel to the margins of the board adjacent the spaces representing the interchangeable weapon positions, so that each space in a particular group of one colour is within range of a particular type of interchangeable weapon having the same coloured portion, the range of a particular interchangeable weapon being measured generally laterally from a particular weapon position to the particular space.

5. A game apparatus as claimed in claim 4 in which the board is further characterized by:

(a) between six and sixteen vertical columns of spaces extending between top and bottom margins of the board, (b) between eight and twenty horizontal rows of spaces extending between side margins of the board, (c) a vertical column of spaces containing between six and twelve spaces representing interchangeable weapon positions being provided adjacent each side margin of the board, there being no more interchangeable weapon positions than horizontal rows of spaces.

6. A game apparatus as claimed in claim 5 in which the board is further characterized by:

(a) nine vertical columns of twelve spaces each extending between the top and bottom margins of the board, the columns being arranged in three equal groups, each group being identified as being within range of a particular type of interchangeable weapon, (b) twelve horizontal rows of nine spaces each extending between side margins of the board, (c) a row of nine spaces representing trenches being disposed adjacent the top and bottom margins of the board, and arranged so as to be parallel to the rows of spaces, (d) a column of nine spaces representing interchangeable weapon positions being disposed adjacent each side margin of the board and arranged so as to be parallel to the columns of of spaces, the interchangeable weapon positions of a particular player being located so as to be also adjacent an end of the board containing bases of that particular player (e) three horizontal rows of nine spaces adjacent the top and bottom margins of the board being the balance of rows that are not protected by interchangeable weapons of both players, thus representing unprotected areas for each player.

* * * * *